US005154391A

United States Patent [19]

Hegarty

[11] Patent Number: 5,154,391

[45] Date of Patent: Oct. 13, 1992

[54] MULTI-PURPOSE DOCUMENT SUPPORT STAND

[76] Inventor: David Hegarty, 36 Wyatt Rd., Garden City, N.Y. 11530

[21] Appl. No.: 642,676

[22] Filed: Jan. 17, 1991

[51] Int. Cl.[5] ..... A47G 1/24

[52] U.S. Cl. ..... 248/454; 248/451; 248/205.2; 248/558

[58] Field of Search ..... 248/454, 451, 452, 453, 248/441.1, 447, 205.2, 558

[56] References Cited

U.S. PATENT DOCUMENTS

| | | | |
|---|---|---|---|
| 741,894 | 10/1903 | Durham | 248/453 |
| 1,011,707 | 12/1911 | Aukeny | 248/451 |
| 3,799,488 | 3/1974 | Sena | 248/452 |
| 3,889,914 | 6/1975 | Torme | 248/451 |
| 4,856,749 | 8/1989 | Habermann | 248/451 |
| 4,925,146 | 5/1990 | Hegarty | 248/458 |

FOREIGN PATENT DOCUMENTS

| | | | |
|---|---|---|---|
| 54438 | 3/1923 | Sweden | 248/451 |

*Primary Examiner*—Blair M. Johnson

[57] ABSTRACT

A multi-purpose document support stand for removably mounting a document holder on the stand includes a planar, plate-like body having a front viewing side and a rear side opposite the front side. The plate-like body is formed in a plurality of sections, including a main section and first and second side sections. The first and second side sections are respectively mounted on opposite lateral sides of the main section and are rotatable with respect to the main section. Each of the side sections includes different types of document holder mounting devices which may be selectively disposed on the front viewing side of the document support stand by rotating one or the other of the side sections.

22 Claims, 4 Drawing Sheets

MULTI-PURPOSE DOCUMENT SUPPORT STAND

BACKGROUND OF THE INVENTION

1. Field of the Invention

This invention relates to document support devices, and more particularly relates to a suspended or desk top stand for supporting documents and document holders in two or more viewing dispositions. Even more specifically, the invention relates to a multi-purpose document support stand.

2. Description of the Prior Art

U.S. Pat. No. 4,925,146, which issued to David Hegarty, the inventor herein, the disclosure of which is incorporated herein by reference, discloses various forms of document support stands for supporting a document or document holder. As described in the Hegarty patent mentioned above, the term "document holder" refers to that type of device which is adapted to secure a document, such as in the form of a book, spiral bound manual, loose-leaf binder or the like, as well as conventional document stands, such as clipboards and the like, and the term "document" refers to a single page or a multiple number of pages.

One form of document support stand disclosed in the Hegarty patent and shown in FIG. 6 of the patent is a suspended type, that is, the stand suspends a document holder above the workplace and may be adjusted both in viewing angle and its rotation. The document support stand includes a conventional, double-arm multi-function support bracket, and a planar plate-like member, which is rectangular in form, rotatably mounted on the support bracket. The plate-like member includes a front side, constituting the viewing side of the document support stand. A C-bracket is mounted on the surface of the viewing side of the plate-like member. The C-bracket defines a T-slot, and is adapted to receive a cooperatively shaped T-rail of a document holder, such as shown in FIG. 3 of the Hegarty patent, so that the document holder may be mounted on and secured to the viewing side of the stand.

OBJECTS AND SUMMARY OF THE INVENTION

It is an object of the present invention to provide a document support stand which is an improvement over that disclosed in the Hegarty patent.

It is another object of the present invention to provide a multi-purpose document support stand adapted for securing different types of document holders in multiple viewing positions.

It is still another object of the present invention to provide a multi-purpose document support stand which can function as a conventional suspended copyholder stand.

It is a further object of the present invention to provide a support stand and document holder, each having cooperating mechanisms for removably mounting the document holder on the support stand.

It is yet another object of the present invention to provide a document support stand that can be easily transformed or converted by the user to support a document holder in different ways.

It is yet another object of the present invention to provide a document support stand which is multi-functioned in structure and adaptable to a variety of applications.

In accordance with one aspect of the present invention, a multi-purpose document support stand for removably mounting a document or document holder on the stand includes a planar, plate-like body. The planar plate-like body has a front viewing side and a rear side opposite the front viewing side. The plate-like body is formed in a plurality of sections and includes a main section having opposite first and second lateral sides, and at least a first side section. The first side section is mounted on the first lateral side of the main section and is rotatable with respect to the main section. Each of the main section and the first side section has a front side and a rear side opposite the front side.

The document support stand further includes a first mounting device, such as a spring biased clip, for removably mounting a document holder on the plate-like body. The first mounting device is disposed on either the front side or the rear side of the first side section.

The document support stand further includes a second mounting device, such as a C-bracket defining an elongated slot, for removably mounting a document holder on the plate-like body. The second mounting device is disposed on the front side of the main section.

The first side section is rotatable between a first position, in which the first mounting device is selectively disposed on the front viewing side of the plate-like body, and a second position, in which the first mounting device is selectively disposed on the rear side of the body.

The multi-purpose document support stand further includes a mechanism for supporting the plate-like body. The plate-like body is mounted on the body supporting mechanism on its rear side.

In a preferred form of the invention, a second side section may be provided. The second side section is mounted on the second lateral side of the main section of the plate-like body and, like the first side section, is rotatable with respect to the main section. The second side section includes front and rear opposite sides, and may include another mounting device, such as Velcro (TM) hook and loop fasteners mounted on one of its sides.

A user of the multi-purpose document support stand may select one of the various types of mounting devices provided on the stand by rotating the first or second side sections so that the desired mounting device is situated on the front viewing side of the document support stand.

These and other objects, features and advantages of this invention will be apparent from the following detailed description of illustrative embodiments thereof, which is to be read in connection with the accompanying drawings.

DETAILED DESCRIPTION OF THE PREFERRED EMBODIMENTS

Figure 1:
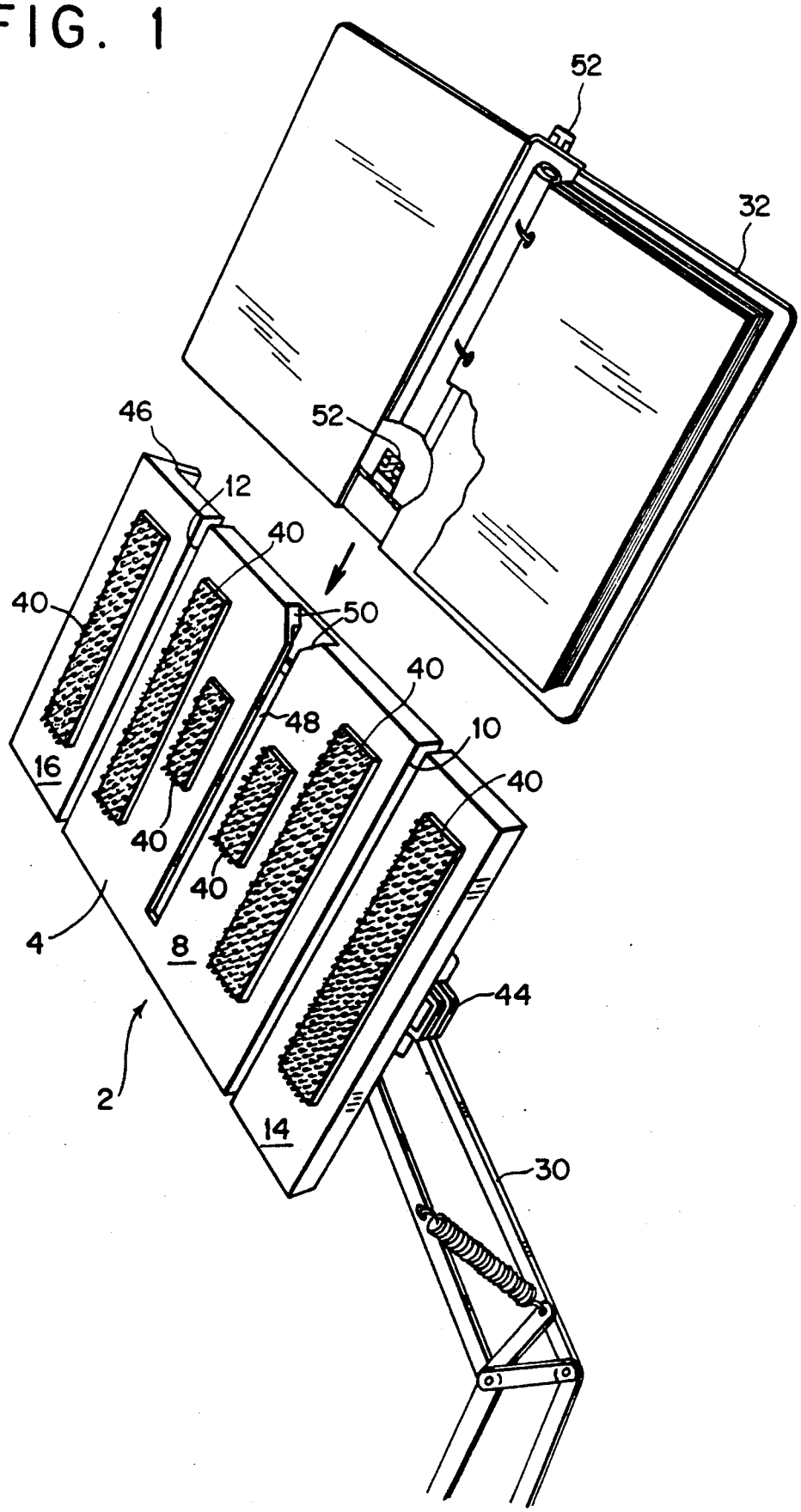
FIG. 1 is a front perspective view of a document support stand and a document holder, partially broken away, constructed in accordance with one form of the present invention.

Referring to FIGS. 1–4 of the drawings, it will be seen that a multi-purpose document support stand, constructed in accordance with the present invention, includes a planar, plate-like body 2 which is rectangular in form. The planar, plate-like body 2 includes a front viewing side 4 and a rear side 6 opposite the front viewing side.

The plate-like body is formed in a plurality of sections, including a main section 8 having opposite first and second lateral sides 10,12, and at least one side section. Preferably, the plate-like body includes first and second side sections 14,16. The first side section 14 is mounted on the first lateral side 10 of the main section and is rotatable with respect to the main section. Similarly, the second side section 16 is mounted on the second lateral side 12 of the main section and is rotatable with respect to the main section. Each of the main section 8, first side section 14, and second side section 16 includes a front side and a rear side opposite the front side.

Figure 4:
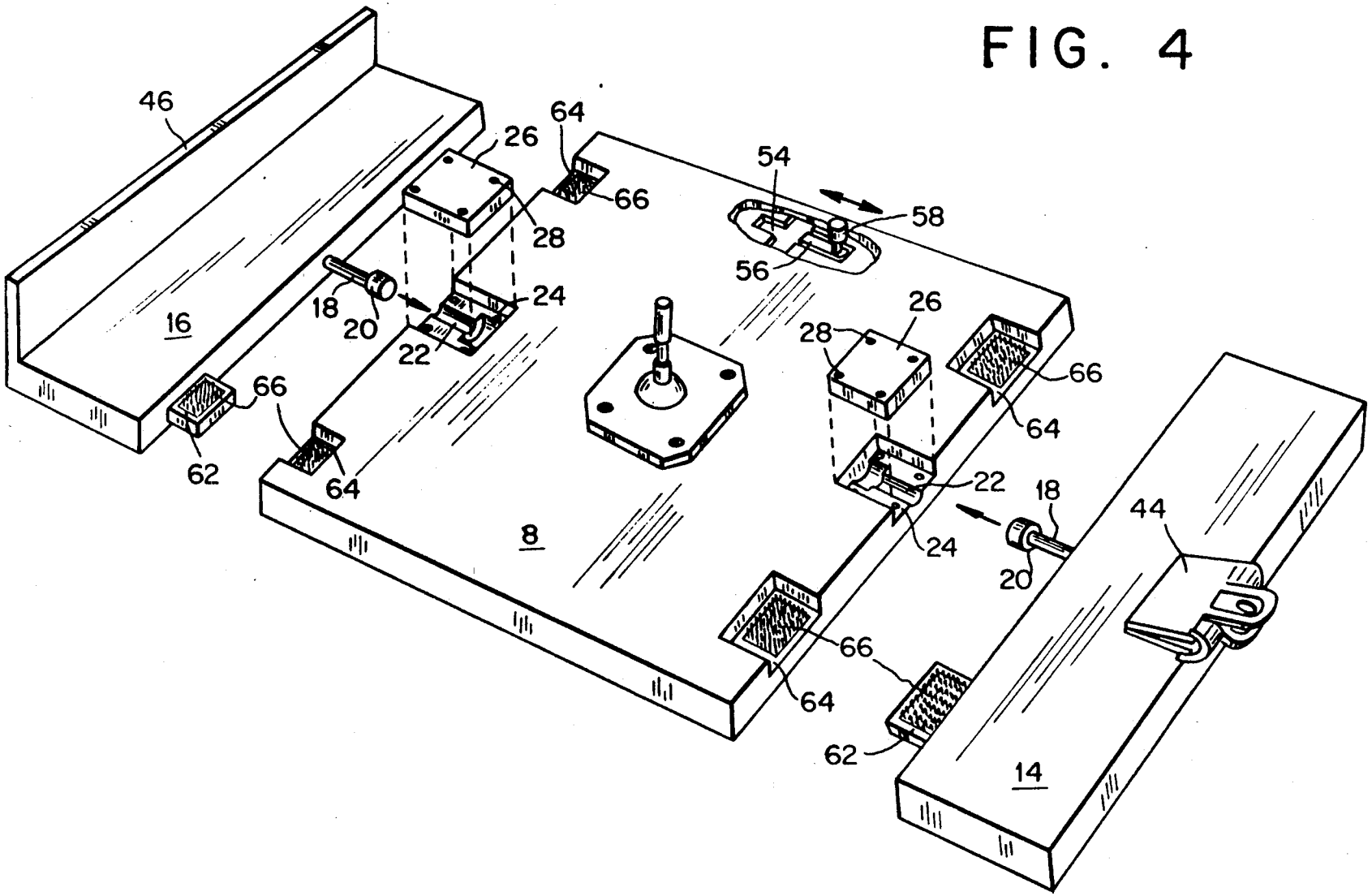
FIG. 4 is a partially exploded view, in perspective and partially broken away, of a portion of the document support stand of the present invention shown in FIG. 1.

Any mechanism which allows the side sections 14,16 to be rotatably mounted on the main section 8 is suitable for use. For example, each side section may include a pin 18 extending from its lateral side adjacent to the respective first and second lateral sides of the main section 8. The pins 18 may include an enlarged free end 20 so that they may be press fitted into and captively received by a bore 22 formed in the lateral edges of the main section. Alternatively, the receiving bores 22 may be at least partially formed in a recessed portion 24 of the rear side of the main section as shown in FIG. 4. The pins 18 are at least partially received by the bores 22 and held in place by blocks 26 mounted in recesses defined by portions 24 and secured to the main section by screws 28 or the like.

Figure 2:
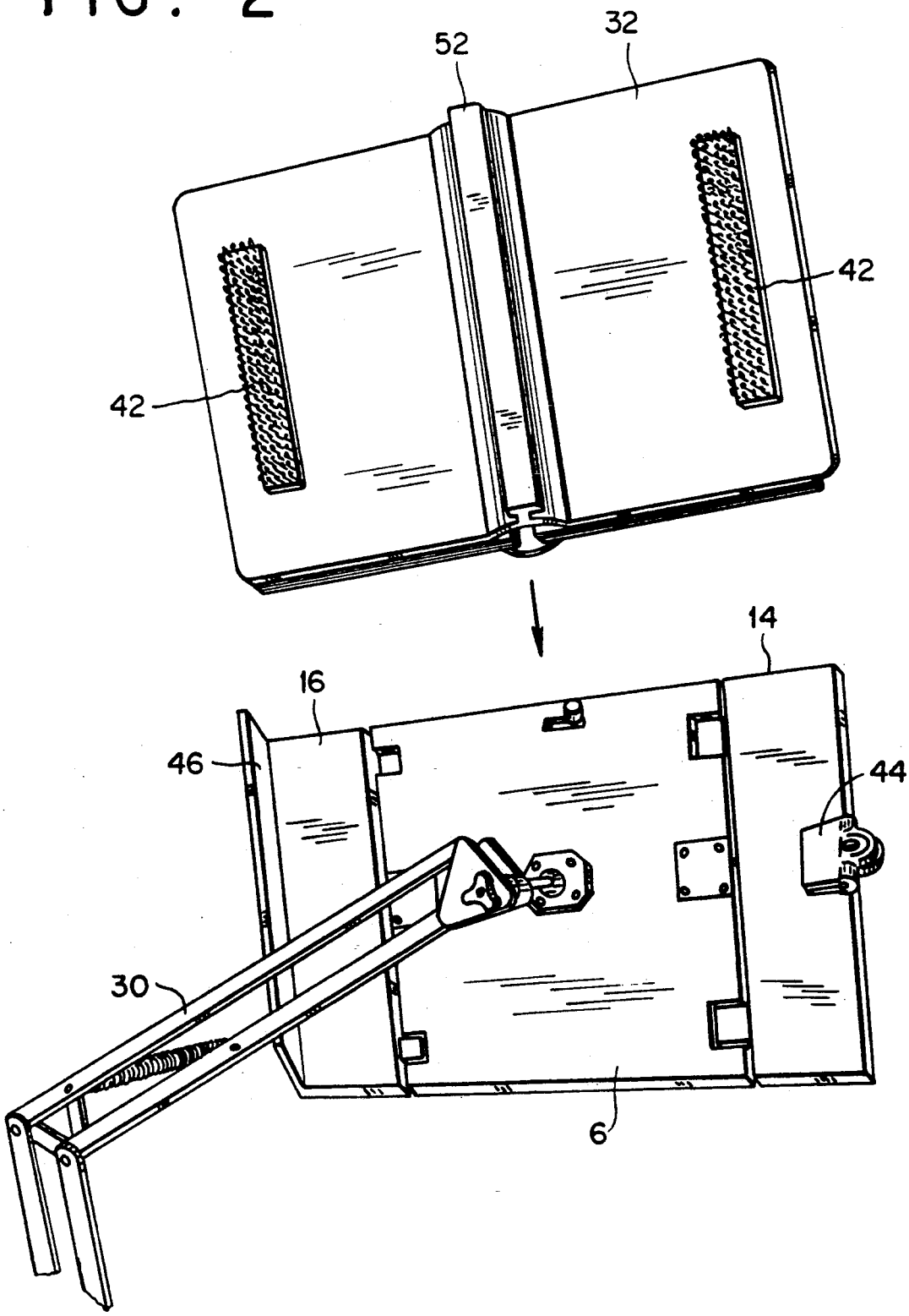
FIG. 2 is a rear perspective view of the document support stand and document holder shown in FIG. 1.

As shown in FIGS. 1 and 2, the document support stand includes a conventional, double-arm multi-function support bracket 30. Such brackets are typically used for supporting a swing arm type lamp over a desk top, drafting table or the like, and are usually mounted at the edge of the desk or table. Such a support bracket 30 is used on the swing-arm lamp Model No. 173-7500, manufactured by Electrix, Inc. Such a support arm is disclosed in U.S. Pat. No. 4,925,146, mentioned previously.

The planar, plate-like body 2 is mounted on the support bracket 30, preferably at the center of the rear side 6 of the main section 8, in the manner disclosed in the aforementioned patent. In this manner, a document holder 32, such as a loose-leaf binder or the like, secured to the document support stand, may be suspended above the workplace and may be adjusted both in the viewing angle and in its rotation. The support bracket 30 allows the plate-like body 2 to be rotated and positioned in a selectable angular disposition about a Z-axis of rotation in order to position the viewing side 4 and a document holder 32 mounted on the viewing side in one of a number of selectable viewing positions. The viewing side of the plate-like body 2 resides in an X-Y coordinate plane, which is perpendicular to the Z-axis of rotation. The support bracket 30 allows the plate-like body to be rotated about the Z-axis of rotation so that the viewing side of the body may be correspondingly turned within the X-Y coordinate plane and adjusted in position within the X-Y coordinate plane.

Figure 3:
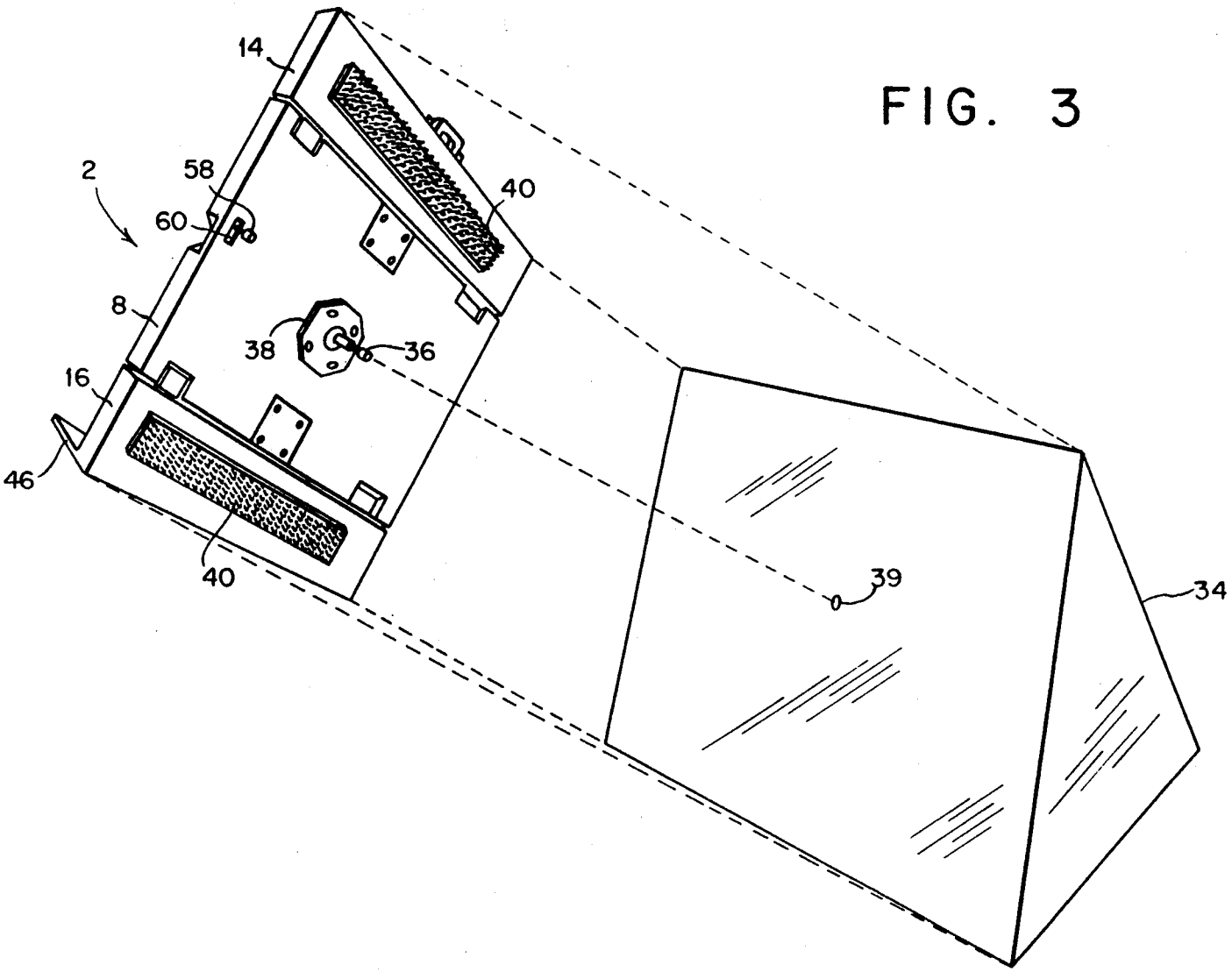
FIG. 3 is a partially exploded view, in perspective, of a document support stand formed in accordance with another form of the present invention.

Alternatively, as illustrated by FIG. 3 of the drawings, the document support stand may include a supporting device in the form of a triangular or pyramidal block 34 or an L-shaped bracket (not shown), to allow the document support stand to be mounted on a desk top, drafting table or the like. In such a case, the document support stand would include a pinion 36 and a flange 38 mounted on an end of the pinion to which the rear side of the main section 8 of the plate-like body is mounted. The pinion 36 is rotatably received in a bore 39 formed in the desk top supporting device 34 to allow the plate-like body 2 to be rotated with respect to the supporting device.

Each of the first side section 14, main section 8 and second side section 16 includes various types of mounting mechanisms for removably mounting a document holder 32, such as a loose-leaf binder or the like, on the plate-like body. For example, the first side section 14 includes one or more Velcro (TM) hook and loop fastening strips 40 disposed on its front side. Similarly, the main section 8 and the second side section 16 includes such fasteners 40 mounted on their front sides. Accordingly, when the first and second side sections 14,16 are positioned in relation to the main section 8 such that the front sides of all three sections constitute the front viewing side 4 of the plate-like body, a series of spaced apart, parallel hook and loop fastening strips 40 are disposed across the viewing side of the plate-like body.

The hook and loop fasteners 40 will allow a document holder 32, such as a loose-leaf binder or the like, having corresponding mating hook and loop fasteners 42 mounted on the front or rear jacket or spine of the document holder to be removably mounted on the front viewing side 4 of the document support stand and held in place on the front side in various dispositions that the plate-like body 2 is placed for viewing by the user. The plurality of hook and loop fastening strips 40 disposed across the front viewing side of the plate-like body will allow various sized document holders to be mounted on the document support stand.

A second type of mounting device is secured to the rear side of the first side section 14. This second type of mounting device may be a resilient or spring biased clip 44 or the like. The first side section 14 may be rotated such that its rear side constitutes part of the front viewing side 4 of the plate-like body 2 so that the spring clip 44 is exposed and situated on the front viewing side of the plate-like body. Accordingly, a user may attach a document holder to the front viewing side of the plate-like body by using the spring clip.

Similarly, the second side section 16 may be rotated with respect to the main section 8 of the plate-like body such that another form of a mounting device, such as a support ledge 46 for a document holder formed as a plate mounted on and protruding normally from the rear side of the second side section, constitutes part of the front viewing side 4 of the plate-like body 2. Accordingly, the user of the document stand may rest a document holder on the support ledge 46, if desired.

The main section 8 of the plate-like body preferably includes another form of a mounting device for removably mounting a document holder 32 on the body. Such a mounting device is in the form of an elongated bracket (not shown) which is C-shaped in cross-section, which bracket defines a T-shaped slot having at least one exposed open end. The C-bracket may be mounted on the front side of the main section. Alternatively, and as shown in FIG. 1, the main section 8 may itself define a slot 48 by forming the same directly in the thickness of the main section 8 on the front side of the main section. The slots and slot defining structures such as the C-bracket are disclosed in the aforementioned U.S. Pat. No. 4,925,146.

The C-bracket or other structure which defines the T-slot may include mutually diverging sides 50 near the open end of the slot to facilitate the insertion of a cooperating elongated rail member 52 formed with a T-shape in cross-section. The T-rail 52 constitutes part of the document holder 32, and may be mounted on the spine or jacket of the document holder, such as the loose-leaf binder-type document holder shown in FIGS. 1 and 2. The T-rail 52 of the document holder is received by the T-slot 48 of the plate-like body 2 so that the document holder 32 may be removably mounted on the front viewing side 4 of the plate-like body and positioned in various angular dispositions by the user.

To ensure that a document holder 32 having a T-rail and mounted on the main section of the plate-like body 2 in the T-slot remains secured to the document support stand, that is, to help prevent the document holder from being removed from the stand or inadvertently sliding out of the open end of the slot 48, the document support stand may include a latch for selectively opening and closing the open end of the slot. More specifically, a channel 54 is formed in the main section 8 of the plate-like body and extends transversely with respect to the T-slot 48 formed in the main section. The channel 54 may extend across the slot, and houses an elongated bar 56 which slides in the channel and which may be selectively positioned across the slot 48 near its open end. A knob 58 mounted on the elongated bar 56 extends through a slotted opening 60 formed in the rear side of the main section. The use may grasp the knob to slide the latch bar 56 to close off the open end of the T-slot 48. The latch mechanism will prevent the T-rail 52 of a document holder from inadvertently sliding out of the open end of the T-slot formed in the plate-like body 2.

To prevent each of the first and second side sections 14,16 from rotating 360 degrees with respect to the main body section 8, each side section includes a tab 62 extending outwardly from a lateral side thereof which is adjacent to the respective first and second lateral sides 10,12 of the main section, and the main section includes recessed portions 64 of its rear side surface to define recesses that are dimensioned and positioned with respect to the tabs 62 of the first and second side sections 14,16 so as to receive the tabs as the side sections are rotated with respect to the main section of the plate-like body. The tabs 62 and cooperating recessed portions 64 of the main section allow the side sections 14,16 to be rotated 180 degrees with respect to the main section 8 so that either the front or rear side of each side section may be positioned with respect to the main section so as to constitute a portion of the front viewing side 4 of the plate-like body 2. Each tab 62 and each recessed portion 64 may further include Velcro (TM) hook and loop fasteners 66 mounted thereon to ensure that the first and second side sections 14,16 are held in a desired position with respect to the main section 8.

As is evident from the structures described above and shown in the drawings, the multi-purpose document support stand is mechanically simple, with few components, and is easily manufactured. The stand can easily be used by the user to hold a document or document holder, such as a loose-leaf binder, book or the like, in a variety of ways. Each of the various types of mounting mechanisms provided on the document support stand may be individually utilized and repositioned so as not to interfere with use of another mounting device on the stand. As can be seen from the drawings, six mounting mechanisms, four of which are different in type, are provided on the document support stand.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A multi-purpose document support stand for removably mounting a document holder thereon, which comprises:

a planar, plate-like body having a front viewing side and a rear side opposite the front side, the plate-like body being formed in a plurality of sections and including a main section having opposite first and second lateral sides a first side section, the first side section being mounted on the first lateral side of the main section and being rotatable with respect thereto about an axis of rotation which is perpendicular to the first lateral side of the main section, each of the main section and first side section having a front side and a rear side opposite the front side; and first mounting means for removably mounting a document holder on the body, the first mounting means being disposed on one of the front side and the rear side of the first side section; and second mounting means for removably mounting a document holder on the body, the second mounting means being disposed on the front side of the main section;

the first side section being rotatable between a first position in which the first mounting means is selectively disposed on the front viewing side of the plate-like body, and a second position in which the first mounting means is selectively disposed on the rear side of the body; and means for supporting the plate-like body, the body being mounted on the body supporting means on the rear side thereof.

2. A multi-purpose document support stand as defined by claim 1, which further comprises means for rotatably mounting the plate-like body on the body supporting means and for positioning the body in a selectable angular disposition about a Z-axis of rotation, the body being rotatable on the supporting means to position the viewing side and a document holder mounted thereon in one of a number of selectable viewing positions, the viewing side residing in an X-Y coordinate plane which is perpendicular to the Z-axis of rotation, the plate-like body being adapted to be rotated about the Z-axis of rotation so that the viewing side thereof is correspondingly turned within the X-Y coordinate plane and adjusted in position within the X-Y coordinate plane.

3. A multi-purpose document support stand as defined by claim 1, which further comprises third mounting means for removably mounting a document holder on the plate-like body, the third mounting means being disposed on the other of the front side and rear side of the first side section and opposite the first mounting means, the third mounting means being disposed on the front viewing side of the plate-like body when the first side section is in the second position, and being disposed on the rear side of the plate-like body when the first side section is in the first position.

4. A multi-purpose document support stand as defined by claim 3, wherein the third mounting means includes a hook and loop fastener.

5. A multi-purpose document support stand as defined by claim 1, wherein the first mounting means includes a biased clip.

6. A multi-purpose document support stand as defined by claim 1, wherein the first mounting means includes a support ledge.

7. A multi-purpose document support stand as defined by claim 1, wherein the second mounting means includes a hook and loop fastener.

8. A multi-purpose document support stand as defined by claim 1, wherein the second mounting means includes means defining an elongated slot, the slot defining means being situated on the front side of the main body section.

9. A multi-purpose document support stand as defined by claim 8, wherein the slot defining means further defines the slot with at least one open end; and which further comprises latch means for selectively opening and closing the open end of the slot.

10. A multi-purpose document support stand as defined by claim 1, which further comprises a second side section, the second side section being mounted on the second lateral side of the main section and being rotatable with respect thereto, the second side section having a front side and a rear side opposite the front side, the second side section including fourth mounting means for removably mounting a document holder on the body, the fourth mounting means being disposed on one of the front side and the rear side of the second side section, the second side section being rotatable between a first position in which the fourth mounting means is selectively disposed on the front viewing side of the plate-like body, and a second position in which the fourth mounting means is selectively disposed on the rear side of the plate-like body.

11. A multi-purpose document support stand for removably mounting a document holder thereon, which comprises:

a planar, plate-like body having a front viewing side and a rear side opposite the front side, the plate-like body being formed in a plurality of sections and including a main section having opposite first and second lateral sides and, a first side section, the first side section being mounted on the first lateral side of the main section and being rotatable with respect thereto about an axis of rotation which is perpendicular to the first lateral side of the main section, each of the main section and first side section having a front side and a rear side opposite the front side; and first mounting means for removably mounting a document holder on the body, the first mounting means being disposed on one of the front side and the rear side of the first side section; and second mounting means for removably mounting a document holder on the body, the second mounting means being disposed on the front side of the main section;

the first side section being rotatable between a first position in which the first mounting means is selectively disposed on the front viewing side of the plate-like body, and a second position in which the first mounting means is selectively disposed on the rear side of the body; and means for supporting the plate-like body, the body being mounted on the body supporting means on the rear side thereof; and means for rotatably mounting the plate-like body on the body supporting means and for positioning the body in a selectable angular disposition about a Z-axis of rotation, the body being rotatable on the supporting means to position the viewing side and a document holder mounted thereon in one of a number of selectable viewing positions, the viewing side residing in an X-Y coordinate plane which is perpendicular to the Z-axis of rotation, the plate-like body being adapted to be rotated about the Z-axis of rotation so that the viewing side thereof is correspondingly turned within the X-Y coordinate plane and adjusted in position within the X-Y coordinate plane.

12. A multi-purpose document support stand as defined by claim 11, wherein the first mounting means includes a biased clip.

13. A multi-purpose document support stand as defined by claim 11, wherein the second mounting means includes means defining an elongated slot, the slot defining means being situated on the front side of the main body section.

14. A multi-purpose document support stand as defined by claim 13, wherein the slot defining means further defines the slot with at least one open end; and which further comprises latch means for selectively opening and closing the open end of the slot.

15. A multi-purpose document support stand as defined by claim 11, wherein the second mounting means includes a hook and loop fastener.

16. A multi-purpose document support stand as defined by claim 11, which further comprises third mounting means for removably mounting a document holder on the plate-like body, the third mounting means being disposed on the other of the front side and rear side of the first side section and opposite the first mounting means, the third mounting means being disposed on the front viewing side of the plate-like body when the first side section is in the second position, and being disposed on the rear side of the plate-like body when the first side section is in the first position.

17. A multi-purpose document support stand as defined by claim 16, wherein the third mounting means includes a hook and loop fastener.

18. A multi-purpose document support stand as defined by claim 11, which further comprises a second side section, the second side section being mounted on the second lateral side of the main section and being rotatable with respect thereto, the second side section having a front side and rear side opposite the front side, the second side section including fourth mounting means for removably mounting a document holder on the body, the fourth mounting means being disposed on one of the front side and the rear side of the second side section, the second side section being rotatable between a first position in which the fourth mounting means is selectively disposed on the front viewing side of the plate-like body, and a second position in which the fourth mounting means is selectively disposed on the rear side of the plate-like body.

19. A multi-purpose document support stand as defined by claim 18, wherein the first mounting means includes a biased clip; and wherein the fourth mounting means includes a support ledge.

20. A multi-purpose document support stand as defined by claim 18, wherein the first mounting means includes a biased clip; wherein the second mounting means includes means defining an elongated slot; and wherein the fourth mounting means includes a support ledge.

21. A multi-purpose document support stand as defined by claim 18, wherein the first mounting means includes a biased clip; wherein the second mounting means includes a hook and loop fastener; and wherein the fourth mounting means includes a support ledge.

22. A multi-purpose document support stand for removably mounting a document holder thereon, which comprises:

a planar, plate-like body having a front viewing side and a rear side opposite the front side, the plate-like body being formed in a plurality of sections and including a main section having opposite first and second lateral sides, a first side section, the first side section being mounted on the first lateral side of the main section and being rotatable with respect thereto, each of the main section and first side section having a front side and a rear side opposite the front side; and first mounting means for removably mounting a document holder on the body, the first mounting means being disposed on one of the front side and the rear side of the first side section; and second mounting means for removably mounting a document holder on the body, the second mounting means being disposed on the front side of the main section;

the first side section being rotatable between a first position in which the first mounting means is selectively disposed on the front viewing side of the plate-like body, and a second position in which the first mounting means is selectively disposed on the rear side of the body, and wherein one of the front side and the rear side of the first side section is coplanar with the front side of the main section; and means for supporting the plate-like body, the body being mounted on the body supporting means on the rear side thereof.

* * * * *